US005129320A

United States Patent [19]

Fadner

[11] Patent Number: 5,129,320

[45] Date of Patent: Jul. 14, 1992

[54] METHOD FOR CONTROLLING VISCOUS INK APPLICATION IN A PRINTING PRESS

[75] Inventor: Thomas A. Fadner, LaGrange, Ill.

[73] Assignee: Rockwell International Corporation, El Segundo, Calif.

[21] Appl. No.: 676,050

[22] Filed: Mar. 27, 1991

[51] Int. Cl.[5] ..... B41F 31/08

[52] U.S. Cl. ..... 101/365; 101/366; 101/483

[58] Field of Search ..... 101/366, 349, 350, 363, 101/364, 489, 484, 483, 211, 170; 346/140 R, 140 A

[56] References Cited

FOREIGN PATENT DOCUMENTS 0268450 11/1986 Japan ..... 101/365
0208949 9/1987 Japan ..... 346/140 R
1113276 9/1984 U.S.S.R. ..... 101/363

*Primary Examiner*—J. Reed Fisher
*Attorney, Agent, or Firm*—C. B. Patti; V. L. Sewell; H. F. Hamann

[57] ABSTRACT

Method and ultrasonic ink metering system for applying ink to a roller 14 in a printing press; the system comprising: an ink supply 20 containing ink; means 22 for pressurizing said ink in said ink supply 20; at least one ink metering device 10 having an internal passageway 30, said internal passageway 30 having an input 32 connected to said ink supply 20 and having an output 36, said metering device 10 also having a nozzle 34 connected to said output 36 of said internal passageway 30 l; at least one piezoelectric transducer 26 attached to said nozzle 34; and variable means 24 for operating said at least one piezoelectric transducer 34 in a power input range; wherein at least the power input of operation of said at least one piezoelectric transducer 34 determines the quantity of ink applied to the roller 14.

16 Claims, 6 Drawing Sheets

METHOD FOR CONTROLLING VISCOUS INK APPLICATION IN A PRINTING PRESS

BACKGROUND OF THE INVENTION

The present invention relates to ink input systems for use in high speed, high volume printing processes using viscous ink such as in offset lithographic printing.

In the field of high speed lithographic printing, ink is continuously conveyed from an ink source by means of a series of rollers to a planographic printing plate on a plate cylinder in a lithographic printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also essential in conventional lithographic printing processes that a dampening solution containing water and proprietary additives be conveyed continuously to the printing plate whereby transferring in part to the non-image areas of the printing plate the water functions to keep those non-image areas free of ink.

In conventional printing press systems, the ink is continuously made available in varying amounts determined by cross-press column input control adjustments to all parts of the printing plate, including both image and non-image areas. In the absence of the dampening solution, the printing plate will accept ink in both the image and non-image areas of its surface.

Lithographic printing plate surfaces in the absence of imaging materials have minute interstices and a hydrophilic or water-loving property to enhance retention of water, that is the dampening solution, rather than ink on the surface of the plate. Imaging the plate creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is essential and integral to the lithographic printing process.

Controlling the correct amount of dampening solution supplied during lithographic printing has been an industry-wide problem ever since the advent of lithography. It requires continual operator attention since each column adjustment of ink input may require a change in dampener input. Balancing the ink input that varies for each column across the width of the press with a uniform dampening solution input across the width of the press is at best a compromise. Consequently, depending upon which portion of the image the operator has adopted as his standard of print quality at any given time during the printing run, the operator may need to adjust the ink input from ink injectors at correspondingly-located cross-press positions. As a result, the dampening solution to ink ratio at that position may become changed from a desired value. Conversely, the operator may adjust a dampener input for best ink and dampening solution balance at one inking column, which may adversely affect the ink and dampening solution balance at one or more other cross-press locations. Adjustments such as these tend to occur repeatedly throughout the whole press run, resulting in slight to significant differences in the quality of the printed image throughout the run. In carrying out these adjustment operations, the resulting images may or may not be commercially acceptable, leading to waste in manpower, materials, and printing machine time.

Certain commercially successful newspaper printing configurations rely on the inking train rollers to carry dampening solution to the printing plate. Notable among these are the Goss Metro, Goss Metroliner, and the Goss Headliner Offset printing presses which are manufactured by the Graphic Systems Division of Rockwell International Corporation. In these alternative configurations, the dampening solution is combined with the ink on an inking oscillator drum such that both ink and water are subsequently and continuously transferred to the inking form rollers for deposition onto the printing plate. These conventional lithographic systems require complex adjusting systems and mechanisms for the ink injectors in order to maintain ink and dampening solution balance, such as disclosed in U.S. Pat. No. 3,534,663.

The present invention overcomes the aforementioned problems, difficulties and inconveniences, yet retains all of the principles essential to prior art variable-input inking systems. Accordingly, in this improvement the mechanical adjustments of the ink injectors are eliminated resulting in a more dependable, smaller and simplified printing fluid input apparatus.

SUMMARY OF THE INVENTION

An object of the present invention is to provide an improved viscous ink input system and the printing press system derived from use thereof which has a simpler ink metering and control means than is required in prior art printing systems such as for lithographic printing.

Another object of this invention is to provide an ink input metering system that has no mechanical moving parts and therefore is virtually maintenance free.

Yet another object is to provide an ink metering means that allows using inks of significantly differing rheological properties without adversely affecting the metering capability of the means.

It is another object of the present invention to provide ultrasonic operated ink metering means for conveying ink to a roller in the lithographic printing press.

The objects are achieved by an ultrasonic ink metering system for applying ink to a roller in the printing press. In the system at least one ink injector which has an internal passageway is provided . The internal passageway has an input connected to an ink supply and has an output. The metering device further has a nozzle connected to the output of the internal passageway. An ink supply is connected to the input of the internal passageway of the ink injector in a manner such that the ink in the passageway is maintained at a slight pressure. At least one piezoelectric transducer is attached to the nozzle of the ink metering device and a variable means for operating the piezoelectric transducer in a amplitude or voltage range at a predetermined frequency is connected to the piezoelectric transducer. In a preferred embodiment the nozzle is a slit aperture for which the narrow dimension provides sufficient restriction that the ink cannot flow through the nozzle slit in the absence of an applied ultrasonic field.

In the present invention a means for pressurizing the ink has a means for establishing the pressure level of the ink in the ink injector to thereby provide an ink pressure value just below that which would be required to cause flow of the ink from the injector orifice onto an ink roller. The quantity of ink actually applied to the roller is determined by the voltage value applied to the piezoelectric transducer. Thus the amount of ink applied to the roller is controlled by operation of only the piezoelectric transducer in conjunction with the preset pressure level of the ink.

In one embodiment of the present invention the metering system has a plurality of ink metering devices or modules, each having a piezoelectric transducer attached thereto, arranged to supply ink to a plurality of portions across the width of a press-wide roller. The variable means for operating the piezoelectric transducers associated with the ink injectors has means for individually adjusting the voltage and therefore the vibratory amplitude of operation of the piezoelectric transducers individually adjusting the voltage of operation of the piezoelectric transducers and therefore of the vibratory amplitude of the transducers characteristic ultrasonic frequency wave. Doing so provides individual variation of the quantity of ink applied to each portion of the width of the roller. Thus the present invention can be used in ink supply systems for example, in newspaper printing press units in which portions of the width of the printed page may require a different amount of ink in order to maintain the proper scale of printed ink optical density for that portion of the page.

In an alternative embodiment of the present invention the nozzle of the ink injector has a plurality of piezoelectric transducers attached thereto in a side-by-side arrangement. The variable means for operating has a means for individually adjusting the amplitude of the operation of each of the piezoelectric transducers. Thus a single ink injector having a width substantially equivalent to the width of the roller can be used or equivalent to one page of the material being printed or a plurality of these types of ink injectors can be arranged to apply ink to a plurality of portions of a width of the roller.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

The present invention has general applicability for controlled variable viscous fluid metering devices and is advantageously utilized in a printing press of the type in which a plurality of vertical columns or portions of a page width that is to be printed need to be individually controlled with regard to the quantity of ink applied to an inking roller of the press. Printing presses are well-known in the prior art which have pressman operated or push-button digitally controlled columns or keys or zones having correspondingly zoned ink input devices such as, for instance, eight injectors per 16 inch wide page in newspaper printing. All of these systems contain or rely upon some form of adjustable and/or moving mechanical parts or pump assembly to meter ink onto an appropriate press roller. Generally, the more automatic the ink input device, the more complicated is the metering device. There is need for a simple but accurate automatic inking device having minimal complexity.

Figure 1:
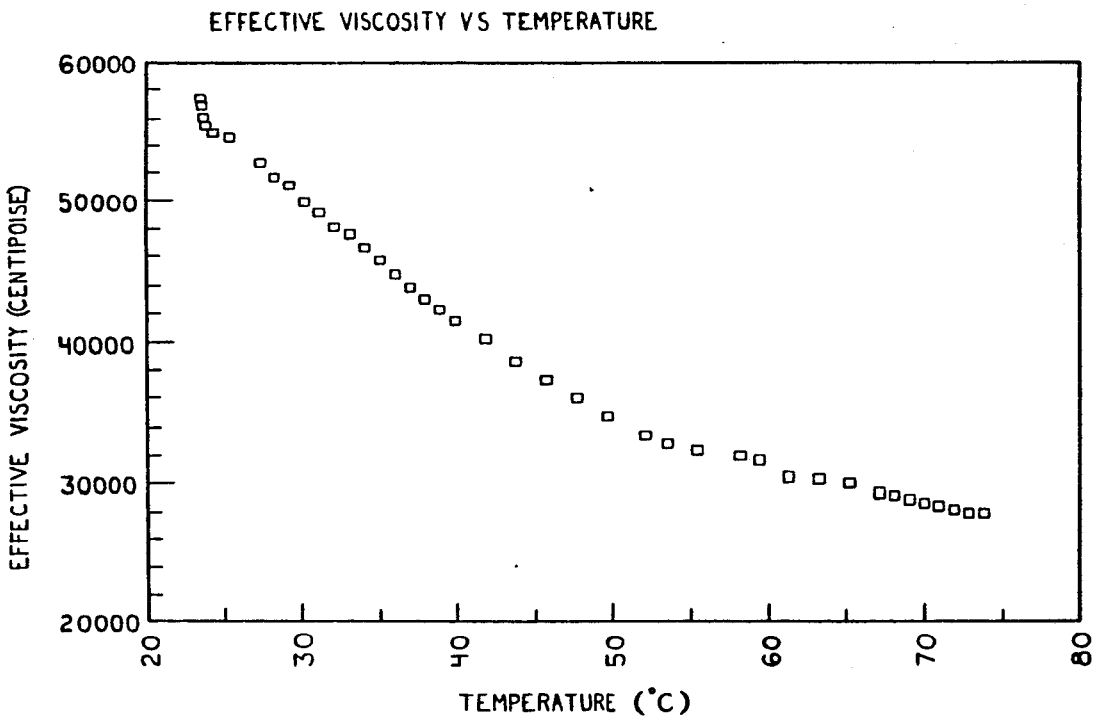
FIG. 1 is a graph of ink viscosity vs. temperature.

It is also well-known in the prior art that the viscosity of typical oil-based letterpress and flexographic inks decreases as a function of an increase in ink temperature and decreases due to an increase in applied shear force rate. For example, FIG. 1 depicts viscosity change, measured by a rotating disc viscometer operating at a low rate of shear, as a function of temperature for a typical newspaper lithographic ink. A 50% reduction in resistance to flow can occur due to a 50° C. increase in ink temperature at this particular constant shear rate. Generally, this characteristic of oil-based or paste inks is not used to advantage in prior art printing practices. In fact, press rollers are often cooled to avoid the viscosity reduction associated with temperature build-up due to heat generated by friction of adjoining rotating press components.

Figure 2:
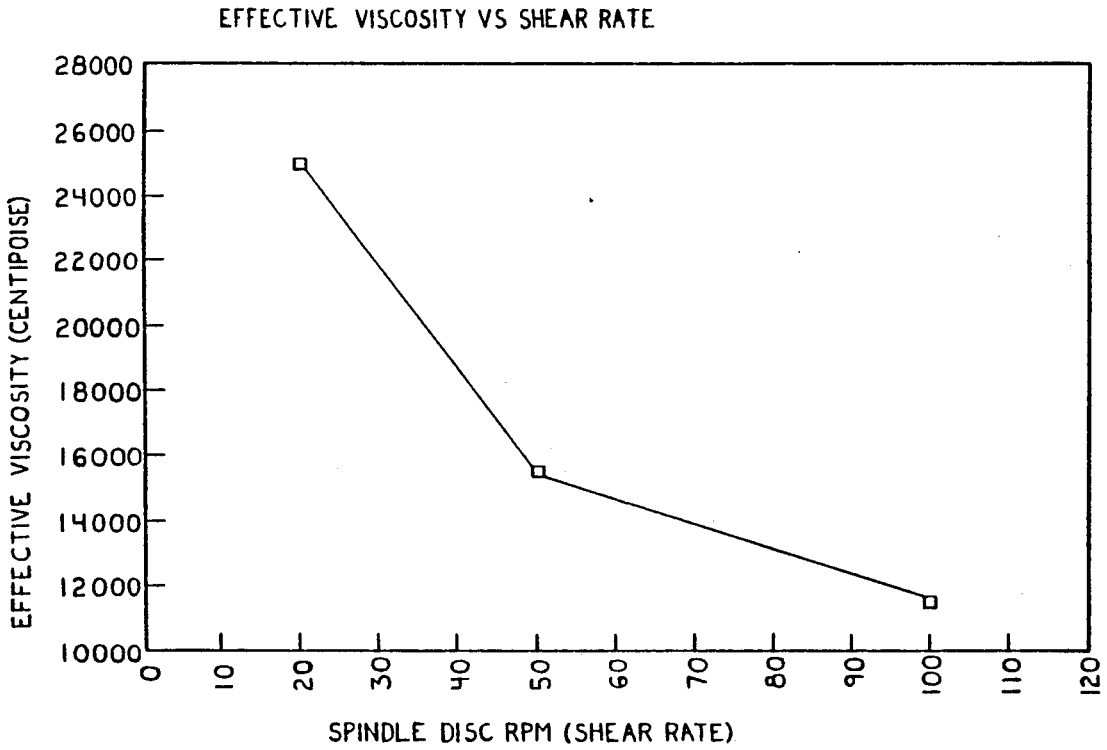
FIG. 2 is a graph of ink viscosity vs. rate of shear forcibly applied to an ink.

FIG. 2 presents a typical effect of shear rate, by means of increasing the disc viscometer's rotating rate, on ink viscosity at constant temperature. Here, a two-fold decrease in viscosity occurs for a five fold increase in applied shear rate. All printing press systems use this characteristic property to effect flow of viscous ink through pipes and to transfer ink from roller to roller of the press system, due to shearing forces applied directly or indirectly by mechanical press components.

Figure 3:
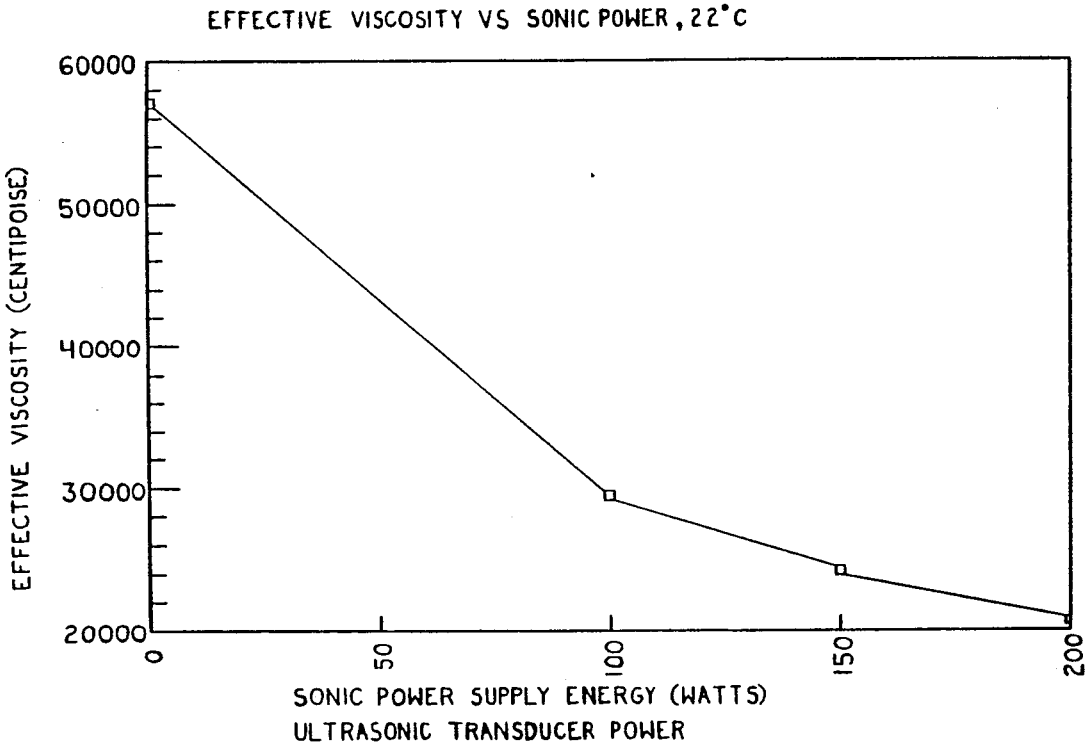
FIG. 3 is a graph of ink viscosity vs. ultrasonic transducer power at a fixed frequency by varying the voltage of the applied alternating current.

It has been discovered that viscosity of an originally viscous ink can be readily reduced by applying an ultrasonic power field to the ink mass held in a suitably orificed container. FIG. 3 depicts a typical constant temperature viscosity reduction result by placing a 20 kHz (kilohertz) ultrasonic probe in close proximity to the viscometer disc element operating at the same low shear rate condition of FIG. 1. The ultrasonic field reduced the ink's resistance to flow (its viscosity) nearly three-fold by application of a probe driving voltage sufficient to consume 200 watts of electric power. It is apparent that low ink viscosity values typical of relatively fluid liquids that had been heated can be obtained in the vicinity of ultrasonic fields without need for temperature increase.

Figure 4:
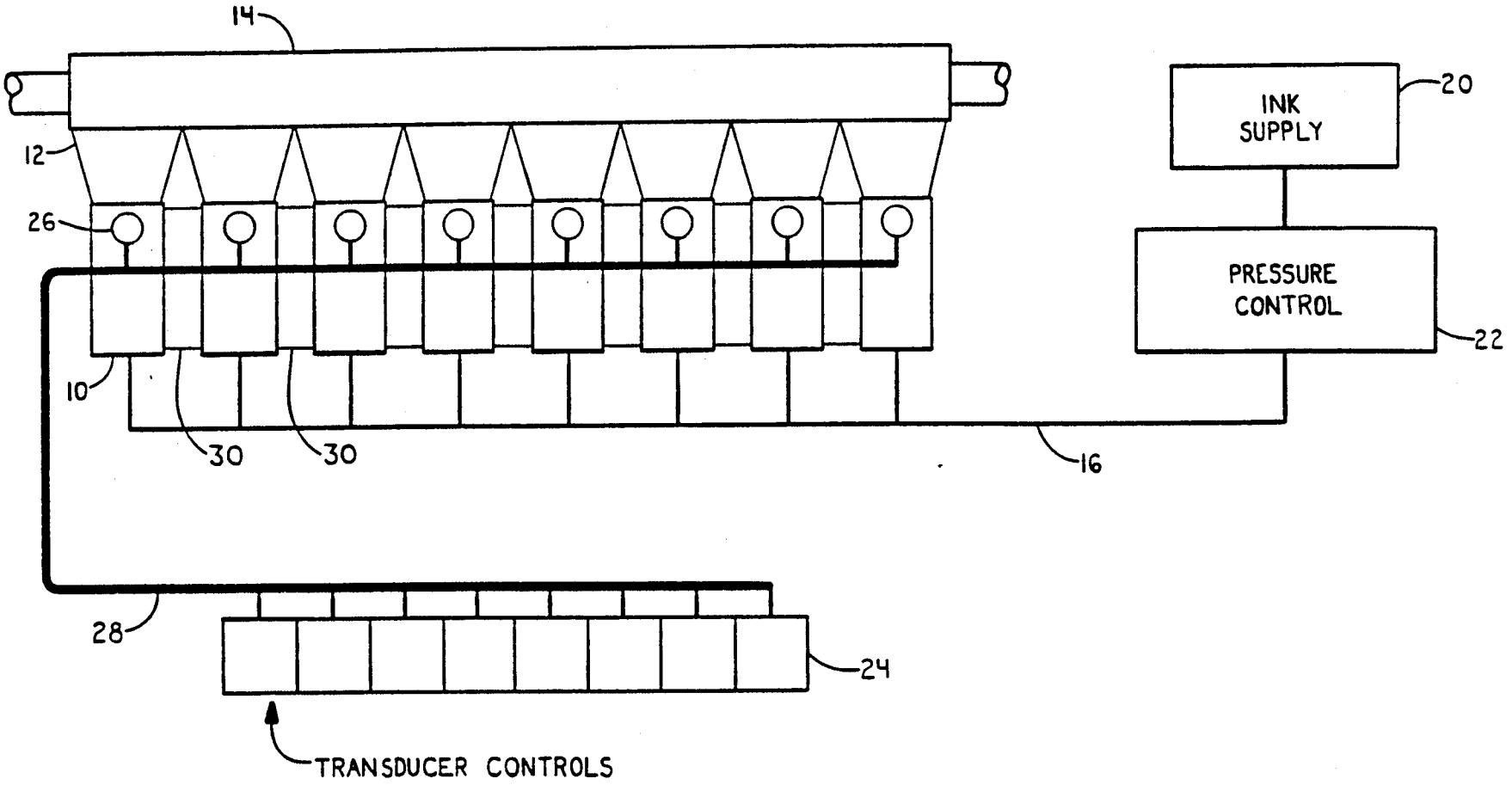
FIG. 4 is a schematic diagram of the ultrasonic ink metering system of the present invention.

FIG. 4 depicts one embodiment of the present invention in which a plurality of ultrasonic ink metering devices 10 are arranged in a side-by-side relationship to enable applications of ink across the whole length of an ink receiving roller 14 of a printing press. To isolate the effects of one ultrasonic field from that on either side, a thin, but effective vibration dampening material 30 matched to the transducers frequency is inserted between each of the ultrasonic ink metering devices 10. In this embodiment, each of the ink metering devices 10 are connected by means of line or header 16 to an ink supply 20 having means 22 to maintain header 16 full of ink at a modest pressure differential relative to atmospheric of up to about 5 PSI. The means for pressure control can be variable to enable different settings to accommodate inks having different operating temperature viscosities. The more viscous an ink is at pressroom temperature, the greater the applied static pressure by means 22 can be. The guiding principles in this invention are that header 16 needs to be maintained full as ink is being metering during press operation onto the receiving roller 14 and that under the null-metering condition of no applied ultrasonic power the ink must not flow or seep from metering device 10. The system depicted in FIG. 4 has individual transducer power controls 24 connected to corresponding piezoelectric transducers 26 of each ink metering device 10 by means of electrical bus 28. The transducer control system 24 independently controls each of the piezoelectric transducers 26 by independently controlling the power input to the transducer. In practice, the press operating console for zoned inking control can be configured similarly to those used to control mechanical inking keys or mechanical pump injector systems.

Figure 5:
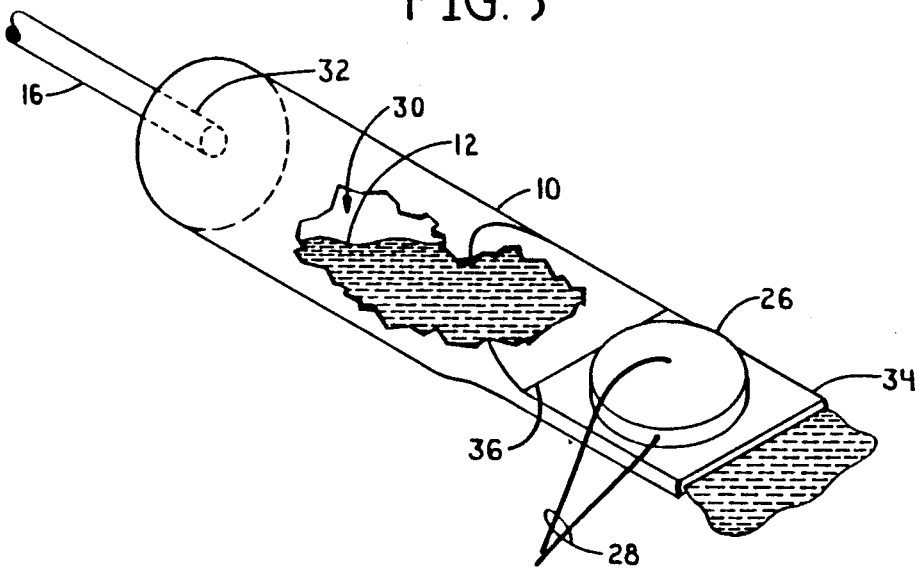
FIG. 5 is a perspective view of one embodiment of an ultrasonic ink metering device.

FIG. 5 depicts an experimental embodiment of the present invention showing an ink metering tube 10 which has an internal passageway 30 with an input 32 connected to the supply line 16 of the ink supply 20. The nozzle 34 is connected to an output 36 of the internal passageway 30 and in one embodiment of the present invention is fashioned as a slit aperture. A disc piezoelectric transducer 26 is attached to the nozzle 34 as shown in FIG. 5. Also shown in FIG. 5 is a lithographic ink 12 contained in the internal passageway 30. Relatively low ultrasonic frequency of controlled amplitude vibrations is appropriately applied via the piezoelectric transducer 26 to the nozzle structure and by transfer to the initially motionless ink 12, reducing the ink's viscosity, allowing the ink 12 to flow by gravity or by slight differential pressure through the slit aperture of the nozzle 34. The higher the amplitude of the applied field, the greater rate at which the ink 12 flows out of the nozzle 34. Thus the present invention provides for a column control ink metering device which unlike prior art devices has no mechanical moving parts.

Figure 6:
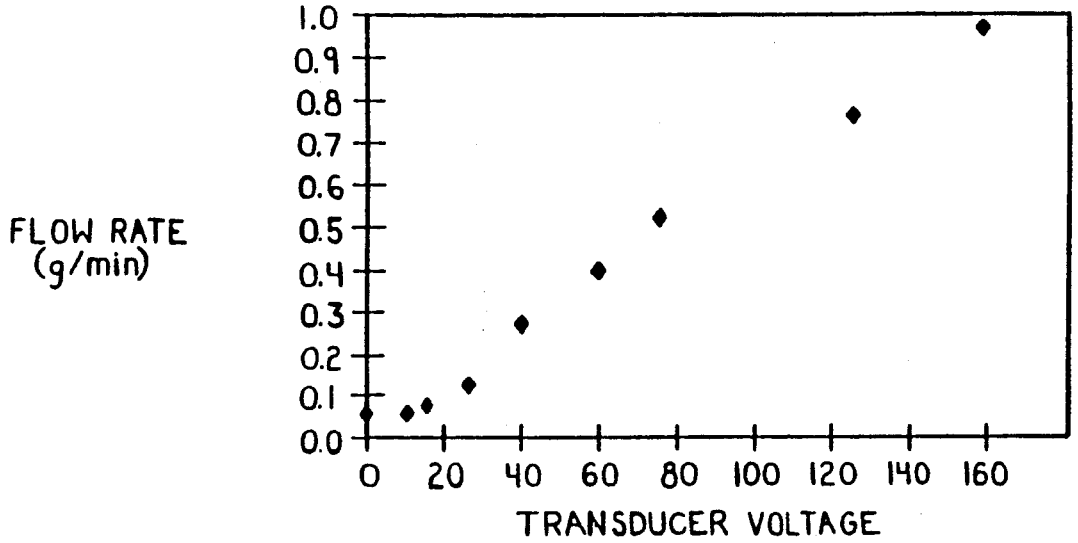
FIG. 6 is a graph of ink flow rate vs. transducer voltage for the FIG. 5 embodiment, at constant applied pressure.
Figure 7:
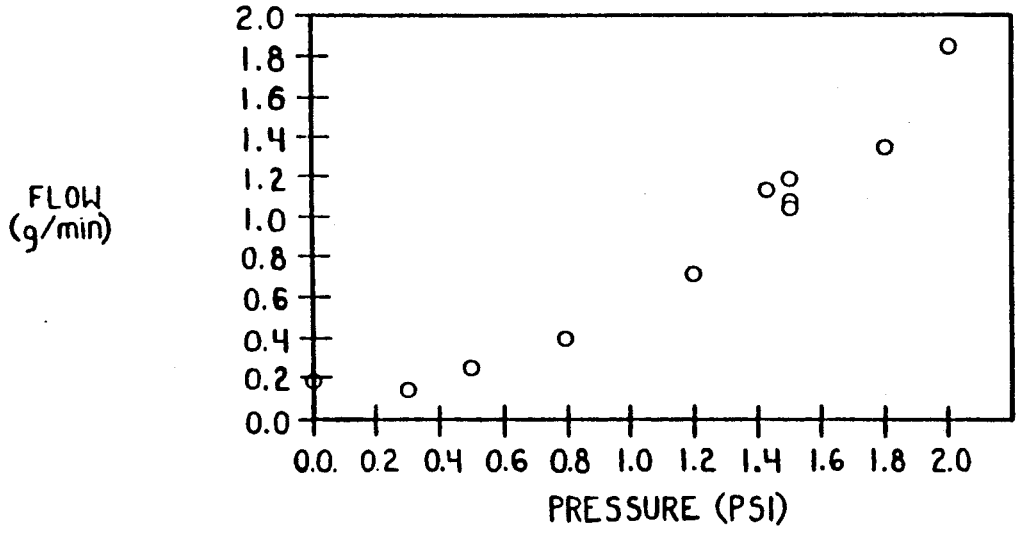
FIG. 7 is a graph of ink flow rate vs. ink pressure at constant voltage to the transducer.

FIGS. 6 and 7 depict experimental results for the FIG. 5 ultrasonic ink metering device. In FIG. 6 the voltage applied to the transducer was varied while a 2 PSI back pressure was maintained on the ink contained in passageway 30. Little or no ink flow occurred until the transducer voltage reached about 10 volts. As voltage was further increased the ink flow rate increased nearly linearly.

In FIG. 7 the static back pressure applied to the ink was varied while the applied voltage was held constant. Increase in back pressure increased the rate of ink flow when values above about 0.3 PSI. In principle either ultrasonic agitation or pressure change can be used to modulate the flow of ink onto a receiving roller.

Figure 8:
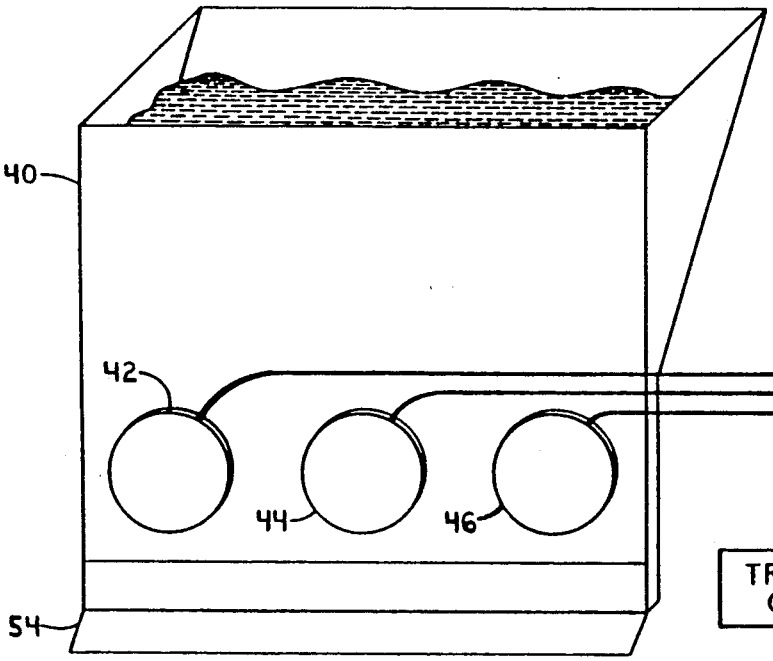
FIG. 8 is a perspective view of another embodiment of the present invention.
Figure 9:
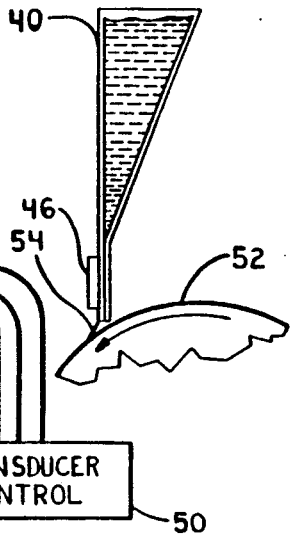
FIG. 9 is a side view of the FIG. 8 ink metering device.

FIGS. 8 and 9 depict an alternative experimental embodiment of the present invention in which 8 inches wide ink metering assembly 40 was constructed using a plurality of piezoelectric transducers 42, 44 and 46 affixed to the crimped portion of the nozzle portion 48 of this wider metering assembly 40 to assure that sufficient ultrasonic power is delivered to the assembly. As a result the ink viscosity is reduced sufficiently to assure flow rates commensurate with printing press input requirements. The transducers 42, 44 and 46 were electrically connected to transducer control 50. Any suitable piezoelectric transducer crystal can be employed and the type of material, geometry of the molded transducer crystal and placement of the transducer crystal on the ink metering assembly can be determined by further practical experimentation. In FIGS. 5 and 8 experiment examples lead zirconate titanate discs are used which resonate at 40 kHz.

The small, "single width" ink metering device depicted in FIG. 5 was constructed from a two inch diameter copper tube with a 0.063 inch thick wall that was compressed on one end into a blade like structure 3 inches wide and 4 inches long with a gap of approximately 1 millimeter to form the nozzle 34. The larger, eight inch wide ink injector depicted in FIG. 8 is similar in configuration and was fabricated from copper sheets with welded seams. For both ultrasonic ink metering devices of FIGS. 5 and 8, a small back pressure or ink pressure typically of up to about 2 PSI is applied to the ink supply. The important operational factor relative to the applied pressure is that its value must be below that required to force flow out of the metering device in the absence of the ultrasonic field. Thus, with the transducer input power set at zero, the system is in the no input or zero mode.

On the basis of qualitative visual observation the effect of ultrasonic power application on flow rate is nearly instantaneous both in causing ink flow when turned on and in terminating ink flow when turned off, implying flow relaxation times shorter then a few tenths of a second. This characteristic is important in the control of ink metering systems since ink input changes to the press will be correspondingly instantaneous. Pressure variation could be used with a constant ultrasonic field to vary ink flow rate as illustrated in FIG. 7. However, pressure changes are not transmitted instantaneously in the required FIGS. 5 and 6 systems and would not have the desired very rapid change from one ink input rate to another.

With the experimental FIG. 5 and FIG. 8 systems, and as expected for other practical systems based on this disclosure, ink appeared to flow at a uniform rate across the width of the ultrasonic metering device implying that the ultrasonic agitation of the ink mass is quite uniform across the width of the device. This property is a distinct advantage over prior art mechanical ink injectors which by forcing viscous ink through a slit nozzle tend to result in a necking ink flow to a dimensioned value less than the nominal slit width dimension. This prior art technology requires special add-on mechanical means to smooth out the ink flow on the receiving roller.

The wider ink metering device 40 depicted in FIG. 8 was constructed for on-press testing in order to demonstrate that the ultrasonic device is suitable for dispensing a thin, uniform ink film under press operating conditions. The ink metering device 40 was installed on a press above the ink feed roller 52 depicted in FIG. 9. A wiper blade 54 was provided at the end of the nozzle 34 to assist adhesion of the output ink to the roller 52. Satisfactory images for the width of the device (approximately 8 inches) were printed at speeds as high as 10,000 impressions per hour. The amount of ink applied to the roller in areas corresponding to each of the piezoelectric transducers 42, 44 and 46 was controlled by means of the transducer control 50 by applying appropriately different voltages to these piezoelectric transducers.

Thus the present invention provides a simple and reliable low cost ink metering device for use in printing presses since no mechanical moving part or adjustable members are required to effect the metering of the ink into the press system. The particular piezoelectric elements used here were 0.118 inches thick and 2 inches in diameter, and were polarized across their thickness with the diametral mode of resonance used to excite vibrations at approximately 40 kHz.

The invention is not limited to the particular details of the apparatus and method depicted and other modifications and applications are contemplated. Certain other changes may be made in the above described apparatus without departing from the true spirit and scope of the invention herein involved. For example, it is envisioned that frequencies of vibration outside of the ultrasonic frequency range used here could be utilized within the spirit of the present invention and devices suitable for imparting such frequencies of vibration could be used instead of piezoelectric transducers. Also other physical configurations of the transducers can be used, since they can be molded to required specifications. Optimized coupling of the ultrasonic field can be provided with regards to ink flow properties. It is intended, therefore, that the subject matter in the above depiction shall be interpreted as illustrative and not in a limiting sense.

What is claimed is:

1. An ultrasonic ink metering system for use in a printing press, comprising:

an ink supply containing ink;

a roller for receiving the ink;

at least one ink input channel having an internal passageway, said internal passageway having an input connected to said ink supply and an output, said channel also having a nozzle connected to said output of said internal passageway, said nozzle emitting ink onto the roller for dispensing a thin uniform ink film across the width of the roller under press operating conditions;

means for pressurizing said ink in at least said internal passageway;

at least one piezoelectric transducer attached to said nozzle; and variable means for operating said at least one piezoelectric transducer in a variable power range;

wherein at least the applied power of operation of said at least one piezoelectric transducer determines the quantity of ink applied to the roller.

2. The ultrasonic ink metering system according to claim 1, wherein said ultrasonic ink metering system comprises a plurality of ultrasonically isolated ink channels, each having a piezoelelectric transducer, arranged to apply ink to a plurality of different portions of a width of the roller, and wherein said variable means for operating said piezoelectric transducers of said ink channels has means for individually adjusting the power input of operation of said piezoelectric transducers, thereby providing individual adjustment of the quantity of ink applied to each portion of the width of the roller.

3. The ultrasonic ink metering system according to claim 1, wherein said nozzle has a plurality of piezoelectric transducers attached thereto in a side-by-side arrangement.

4. The ultrasonic ink metering system according to claim 3, wherein said variable means for operating has means for individually adjusting the power input of each of said piezoelectric transducers.

5. The ultrasonic ink metering system according to claim 4, wherein said ultrasonic ink metering system comprises a plurality of ink channels arranged to apply ink to a plurality of portions of a width of the roller.

6. The ultrasonic ink metering system according to claim 1, wherein said nozzle is a slit apparatus.

7. The ultrasonic ink injector system according to claim 1, wherein said means for pressurizing said ink has means for providing pressure to a level only less than required to cause ink flow in the absence of applied power to the at least one piezoelectric transducer.

8. An ultrasonic ink metering system for use in a printing press, comprising:

a roller for receiving ink;

at least one means for applying ink to the roller and having a nozzle for emitting ink onto the roller for dispensing a thin uniform ink film across the width of the roller under press operating conditions;

means for supplying ink to said at least one means for applying ink;

said at least one means for applying ink having at least one means for imparting ultrasonic vibrations to the ink in said means for applying ink such that the rate of ink output of said at least one means for applying ink is at least a function of power input to said means for imparting ultrasonic vibrations, said at least one means for imparting ultrasonic vibrations being attached to said nozzle;

variable means for operating said at least one means for imparting ultrasonic vibrations in a power input range;

wherein at least the power input of operation of said at least one means for imparting ultrasonic vibrations determines the quantity of ink applied to the roller.

9. The ultrasonic ink metering system according to claim 8, wherein said ultrasonic ink metering system comprises a plurality of means for applying ink, each means for applying ink having a means for imparting ultrasonic vibrations, arranged to apply ink to a plurality of portions of a width of the roller, and wherein said variable means for operating said means for imparting ultrasonic vibrations of said means for applying ink has means for individually adjusting the power input of operation of said means for imparting ultrasonic vibrations thereby providing individual adjustment of the quantity of ink applied to each portion of the width of the roller.

10. The ultrasonic ink metering system according to claim 8, wherein said nozzle has a plurality of means for imparting ultrasonic vibrations attached thereto in a side-by-side arrangement.

11. The ultrasonic ink metering system according to claim 10, wherein said variable means for operating has means for individually adjusting the power input to each of said means for imparting ultrasonic vibrations.

12. The ultrasonic ink metering system according to claim 11, wherein said ultrasonic ink metering system comprising a plurality of means for applying ink arranged to apply ink to a plurality of portions of a width of the roller.

13. The ultrasonic ink metering system according to claim 8, wherein said nozzle has a slit aperture for outputting the ink.

14. The ultrasonic ink metering system according to claim 8, wherein said ultrasonic ink metering system further comprises means for pressurizing said ink in said at least one means for applying ink, and wherein said means for pressurizing said ink has means for providing only a pressure level less than required to cause ink flow in the absence of applied power to the at least one piezoelectric transducer.

15. A method for applying ink for use in a printing press, comprising the steps of:

providing a roller for receiving ink;

providing at least one means for applying ink to the roller for dispensing a thin uniform ink film across the width of the roller under press operating conditions, said at least one means for applying ink having a nozzle for emitting ink;

supplying ink to said at least one means for applying ink;

imparting ultrasonic vibrations to the ink at the nozzle of said at least one means for applying ink such that the rate of ink output of said at least one means for applying ink is at least a function of a power input of said ultrasonic vibrations;

varying said ultrasonic vibrations in a power input range of operation;

wherein at least the power input of operation for imparting ultrasonic vibrations determines the quantity of ink applied to the roller by said at least one means for applying ink.

16. The method according to claim 15, wherein the method further comprises the steps of:

pressurizing said ink at least in said at least one means for applying ink; and providing only a pressure level less than required to cause ink flow in the absence of the power input for the ultrasonic vibrations.

* * * * *